US007107685B1

(12) United States Patent
Anderson

(10) Patent No.: US 7,107,685 B1
(45) Date of Patent: Sep. 19, 2006

(54) FOLDING KNIFE WITH DEVICE TO AID IN OPENING

(75) Inventor: Thomas Anderson, Manchester, PA (US)

(73) Assignee: Master Cutlery Inc., Secaucus, NJ (US)

( * ) Notice: Subject to any disclaimer, the term of this patent is extended or adjusted under 35 U.S.C. 154(b) by 0 days.

(21) Appl. No.: 11/077,836

(22) Filed: Mar. 11, 2005

(51) Int. Cl.
*B26B 1/02* (2006.01)

(52) U.S. Cl. ..... 30/158; 30/160

(58) Field of Classification Search ..... 30/57, 30/152, 155, 158, 331, 342, 160; 81/440, 81/427.5, 177.4; 7/118, 129, 132
See application file for complete search history.

(56) References Cited

U.S. PATENT DOCUMENTS

| | | | | |
|---|---|---|---|---|
| 4,974,323 | A | 12/1990 | Cassady | 30/158 |
| 5,331,741 | A | 7/1994 | Taylor, Jr. | 30/158 |
| 5,615,484 | A | 4/1997 | Pittman | 30/161 |
| 5,839,194 | A | 11/1998 | Bezold | 30/161 |
| 6,079,106 | A * | 6/2000 | Vallotton | 30/161 |
| 6,360,443 | B1 * | 3/2002 | Remus | 30/158 |
| 6,378,214 | B1 | 4/2002 | Onion | 30/161 |
| 6,397,476 | B1 * | 6/2002 | Onion | 30/160 |
| 6,789,323 | B1 * | 9/2004 | Moizis | 30/155 |
| 2001/0039735 | A1 | 11/2001 | Neveux | 30/161 |
| 2002/0104220 | A1 * | 8/2002 | Marfione | 30/160 |
| 2004/0031155 | A1 | 2/2004 | Hitchcock | 30/161 |
| 2004/0045171 | A1 | 3/2004 | Moizis | 30/161 |
| 2004/0088865 | A1 * | 5/2004 | Onion | 30/161 |
| 2004/0134075 | A1 | 7/2004 | Chu | 30/161 |

FOREIGN PATENT DOCUMENTS

| | | | |
|---|---|---|---|
| DE | 1104386 | * | 4/1961 |

* cited by examiner

*Primary Examiner*—Boyer D. Ashley
*Assistant Examiner*—Laura M. Brean
(74) *Attorney, Agent, or Firm*—Walter J. Tencza, Jr.

(57) ABSTRACT

An apparatus for opening a folding knife is provided. The apparatus may include a plate having an arcuate slot and a substantially linear slot. A cam slide may be provided comprised of an extension which extends into the substantially linear slot, and an opening into which a post connected to a blade device can be inserted. The extension of the cam slide typically can be moved in a substantially linear manner in the substantially linear slot. The substantially linear movement of the extension in the substantially linear slot causes a sharp edge of the blade device to come out of or go into a housing.

20 Claims, 8 Drawing Sheets

FOLDING KNIFE WITH DEVICE TO AID IN OPENING

FIELD OF THE INVENTION

This invention relates to improved methods and apparatus concerning folding knives.

BACKGROUND OF THE INVENTION

Typically in the prior art one has to open a folding knife by grabbing the outer surface of a blade of the knife and pulling and/or rotating the blade out of a housing. There are also switchblade knives which are known which allow one to press a single button, and in response a blade immediately springs out from a fully closed position within a housing to a fully opened position outside of the particular housing.

U.S. Pat. No. 4,974,323 to Cassady discloses a folding knife which can be opened by applying finger pressure to a stem portion 30. (Cassady, FIGS. 10–15; col. 5, Ins. 65-col. 8, In. 3). The stem portion 30 is attached to a control plate 28 which can move within a cavity 52 of an engagement plate 50. The control plate 28 is attached to a crankpin 24 which can move within an arcuate crankpin slot 48. The crankpin 24 is attached to a knife 20. (Cassady, FIG. 3, col. 4, Ins. 55–65).

In Cassady, in order to move the knife 20 from a fully closed position (Cassady, FIG. 10) to a fully opened position (Cassady, FIG. 14 or 15), finger pressure is applied to the stem portion 30 first in an easterly and southerly direction, until the heal 38 and toe 34 of the plate 28 are in a bypass slot 56 (FIG. 13, partially opened position) and thereafter in a westerly and northerly direction until the heal 38 and toe 34 of the plate 28 are outside the slot 56. (Cassady, FIG. 14 or FIG. 15; col. 5, Ins. 65-col. 8, In. 3) The requirement that an operator move the plate 28 in multiple and opposing directions in order to operate the Cassady device, makes the device cumbersome to operate.

SUMMARY OF THE INVENTION

The present invention, in one or more embodiments, provides an apparatus and a method for opening a folding knife. The apparatus and method allow one to open a folding knife without actually touching the knife portion or blade of the knife. In one embodiment, a button attached to an extension of a cam slide can be slid in a substantially linear direction to open the folding knife.

The present invention, in one or more embodiments, provides an apparatus comprising a blade device including a knife portion having a sharp edge. The apparatus may further include a housing. The blade device may be pivotally mounted to the housing by a pivot pin so that the sharp edge can be rotated in or out of the housing to place the apparatus in a closed state or an opened state, respectively. A post may be part of or attached to the blade device. The apparatus may further include a plate having an arcuate slot and a substantially linear slot. A cam slide may also be provided comprised of an extension which extends into the substantially linear slot, and an opening into which the post can be inserted. The extension of the cam slide typically can be moved in a substantially linear manner in the substantially linear slot. The substantially linear movement of the extension in the substantially linear slot causes the sharp edge to come out of or go into the housing.

The substantially linear slot typically has a length and a width. The length may be substantially greater than the width. The extension of the cam slide is typically connected to a button which lies outside of the substantially linear slot, but which can be slid parallel to the direction of the length of the substantially linear slot to cause the cam slide to move and to thereby cause the sharp edge to come out of or go into the housing. The plate may have a length and a width, wherein the length of the plate is greater than the width. The arcuate slot may lie substantially to one side of a line segment running the length of the plate and bisecting the plate. The arcuate slot may be shaped substantially in the form of a semi-circle. The substantially linear slot may lie at an angle with respect to the length of the plate.

The arcuate slot may have a first end and a second end, wherein the first end and the second end both lie approximately along a line segment which bisects the plate along the length of the plate. The substantially linear slot may have a first end which lies approximately along the line segment which bisects the plate. The plate may have a hole into which the pivot pin can be inserted. The arcuate slot may at least partially surround the hole of the plate. The arcuate slot may be substantially in the form of a semi-circle and the hole may be located such that if the semi-circle were made into a complete circle, the hole would be at the center of the complete circle.

The knife portion and the housing may each have a length and a width, wherein the lengths are substantially greater than their widths. The apparatus may be comprised of a locking liner having a flexing portion which can be used keep the knife portion in an fully opened position in which the length of the knife portion is substantially parallel to the length of the housing.

The present invention, in one or more embodiments, also includes a method comprising the steps of providing a blade device in an apparatus including a knife portion having a sharp edge, wherein the blade device includes a post, and pivotally mounting the blade device to a housing by a pivot pin so that the sharp edge can be rotated in or out of the housing to place the apparatus in a closed state or an opened state, respectively. The method also includes providing a plate having an arcuate slot and a substantially linear slot, and providing a cam slide comprised of an extension which extends into the substantially linear slot, and an opening into which the post can be inserted.

DETAILED DESCRIPTION OF THE DRAWINGS

Figure 1:
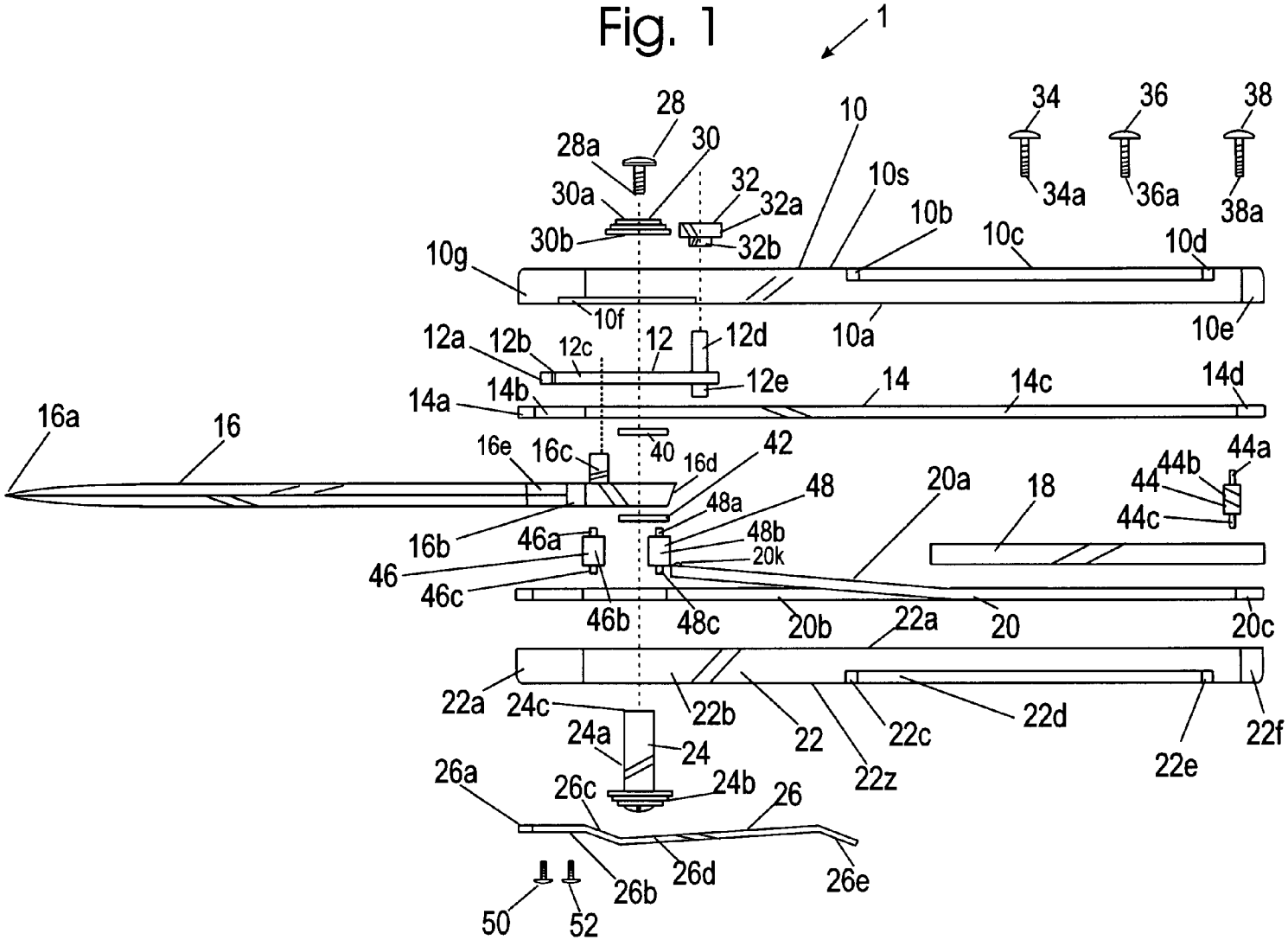
FIG. 1 shows a bottom view of an apparatus in accordance with an embodiment of the present invention, with the apparatus shown disassembled.

FIG. 1 shows a bottom view of an apparatus 1 in accordance with an embodiment of the present invention, with the apparatus 1 shown disassembled. The apparatus 1 includes slide side overlay 10, cam slide 12, plate 14, blade device 16, spacer 18, locking liner 20, lock side overlay 22, pivot pin 24, and pocket clip 26. The slide side overlay 10 and the lock side overlay 22 when connected together may be considered to be a housing.

The apparatus 1 also includes screw 28, pivot collar 30, slide button 32, frame screws 34, 36, and 38, washers 40 and 42, alignment pin 44, stop pins 46 and 48, and pocket clip screws 50 and 52.

Figure 6:
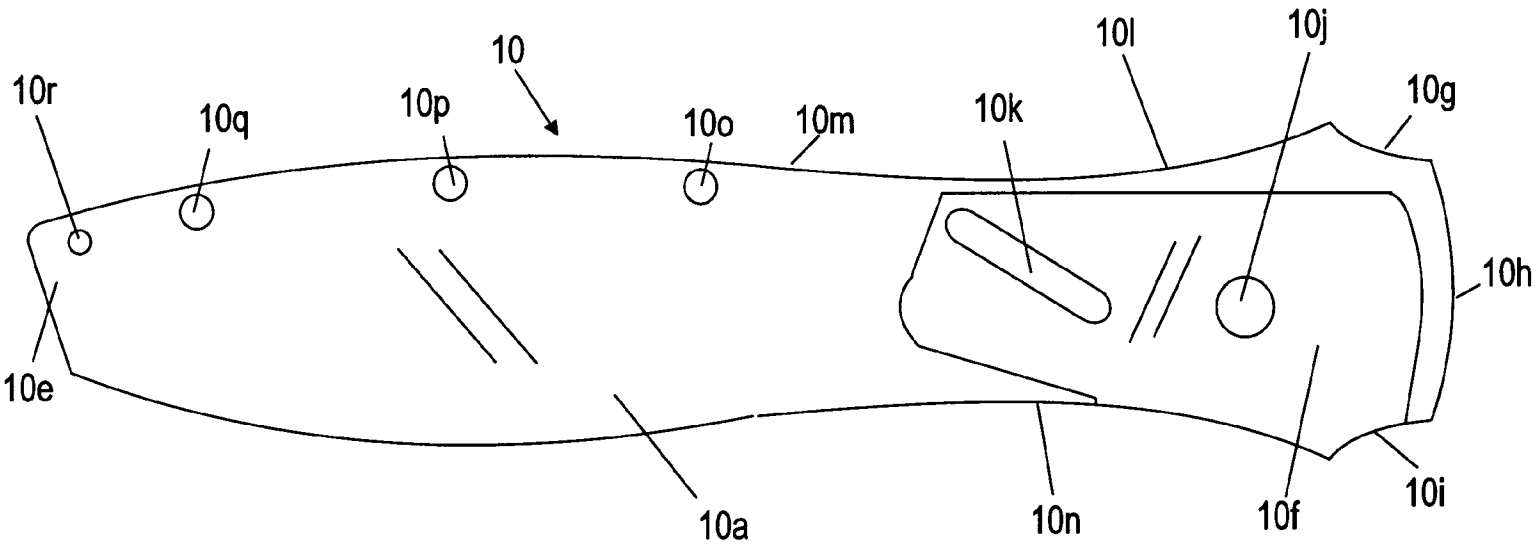
FIG. 6 shows a rear view of the slide side overlay for use with the apparatus of FIG. 1.
Figure 7:
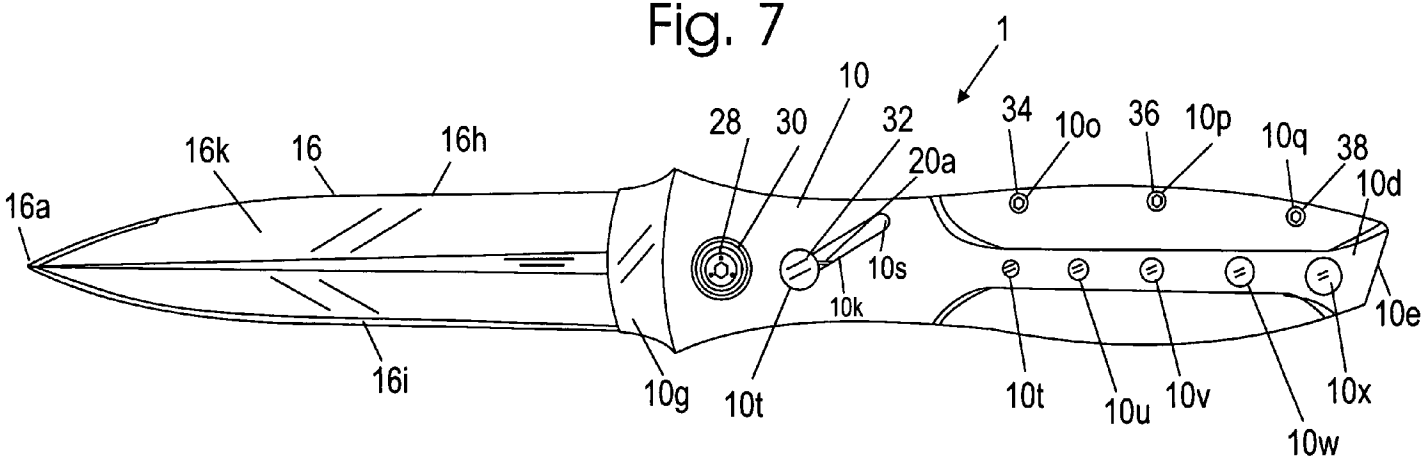
FIG. 7 shows a front view of the apparatus of FIG. 1 in an assembled state.

A rear view of the slide side overlay 10 is shown in FIG. 6. FIG. 7 shows a front view of the slide side overlay 10. The slide side overlay 10 is typically a metal plate having a recessed or indented area 10*f* in which is located an elongated channel or opening 10*k* and a circular opening 10*j*. The indented area 10*f* is located on the rear side 10*a*. Referring to FIG. 1, the rear or back side of slide side overlay 10 includes portions 10*c*, 10*b*, and 10*d*, which may together form a decorative outer portion shown in FIG. 7. The portion 10*c* may include decoration components 10*t*, 10*u*, 10*v*, 10*w*, and 10*x*. The slide side overlay 10 further includes sides 10*e*, 10*m*, 10*g*, 10*h*, 10*i*, and 10*n*, shown in FIG. 6. The slide side overlay 10 also includes holes or openings 100, 10*p*, 10*q*, and 10*r*. The slide side overlay 10 may be substantially a solid metal plate with the exception of the channels or openings shown.

Figure 2:
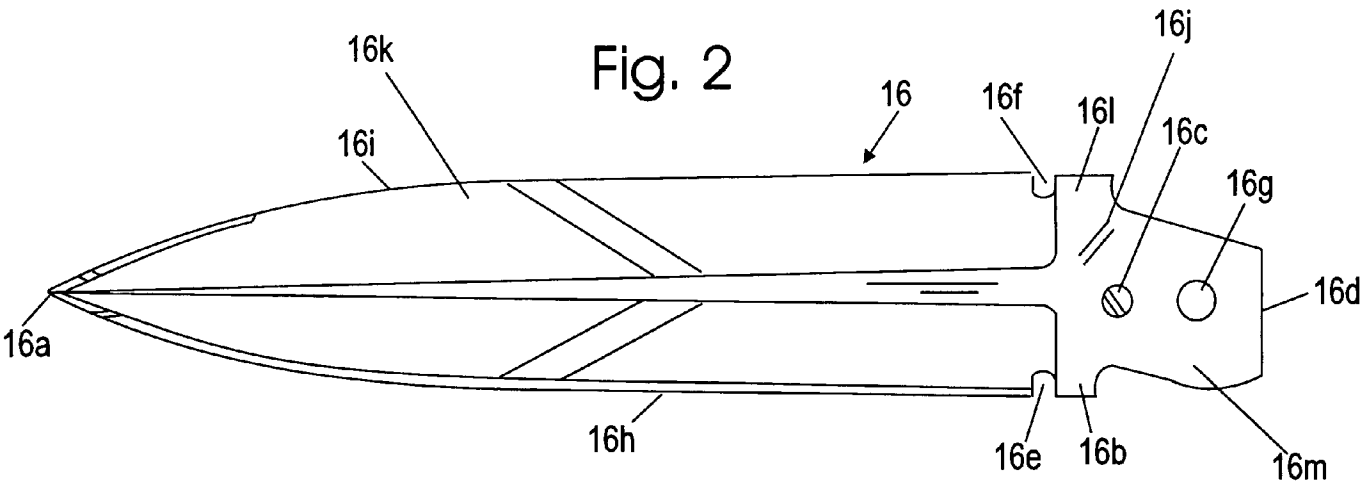
FIG. 2 shows a front view of a blade device for use with the apparatus of FIG. 1.
Figure 8:
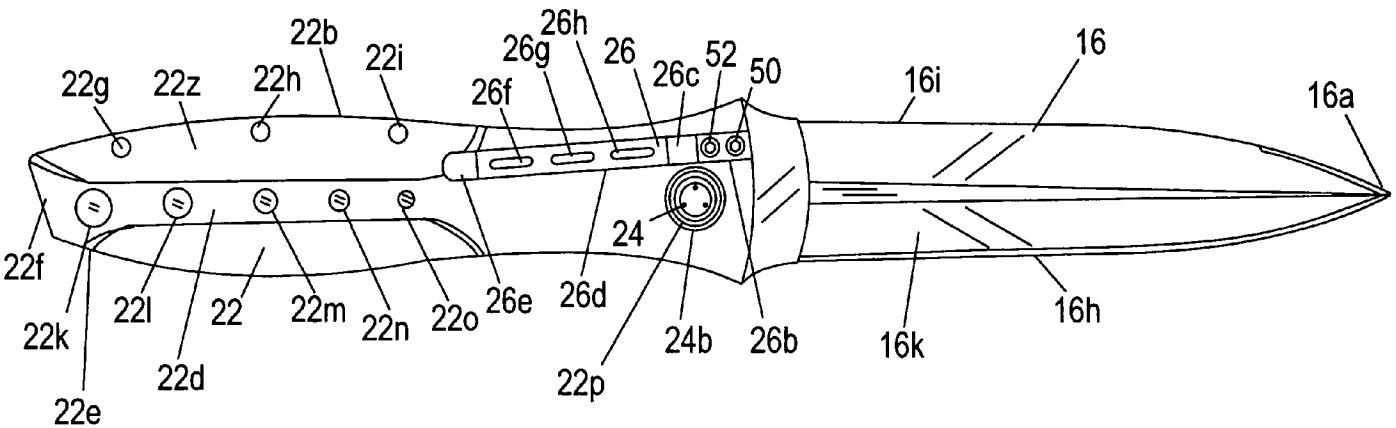
FIG. 8 shows a rear view of the apparatus of FIG. 1 in an assembled state.

FIG. 2 shows a front view of the blade device 16 for use with the apparatus 1 of FIG. 1. FIG. 7 shows a portion of the front view of the blade device 16. FIG. 8 shows a rear view of the blade device 16. Referring to FIGS. 1 and 2, the blade device 16 includes a sharp edge 16*h* at its bottom, and an edge 16*i* at its top, which is thicker than the sharp edge 16*h* and typically unsharpened. The blade device 16 has a pointed left end 16*a* and a straight edged, non-sharpened thicker right end 16*d*. The blade device 16 can be thought of as being comprised of a knife or blade portion 16*k* and a thicker connection device 16*j*. The knife portion 16*k* includes notches 16*e* and 16*f*. The connection device 16*j* includes top protrusion 161 and bottom protrusion 16*b*, and extension portion 16*m*, which ends at end 16*d*. An extension, protrusion, or post 16*c* as shown in FIG. 1, extends outward from connection device 16*j*. The post 16*c* may be considered to be part of blade device 16 or attached to blade device 16. A circular hole 16*g* is located in the connection device 16*j*.

Figure 3:
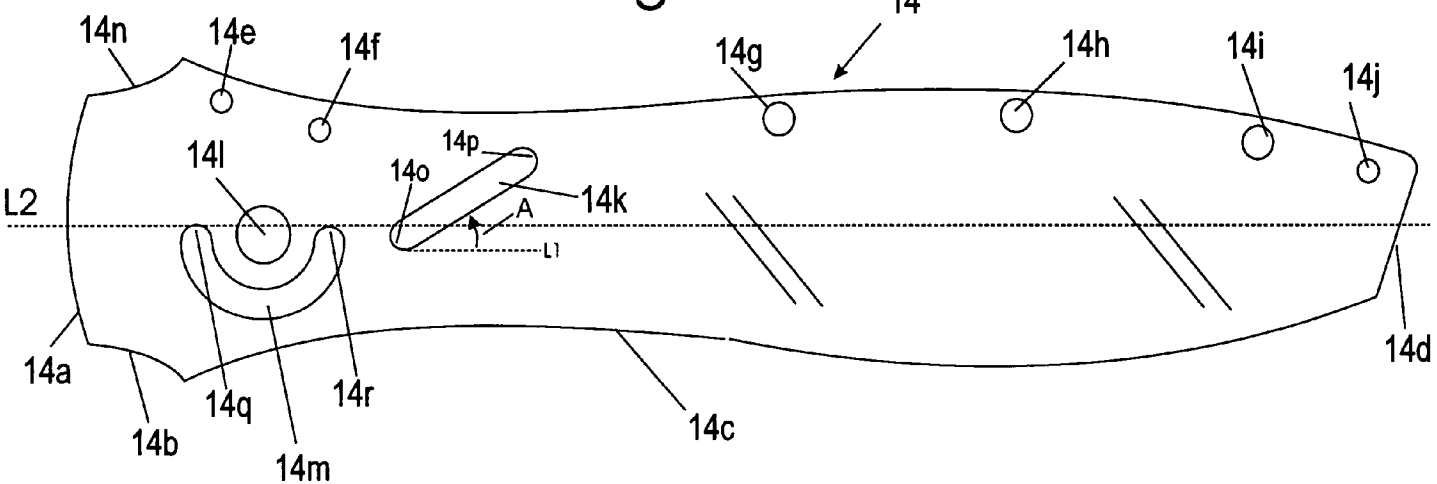
FIG. 3 shows a front view of a plate for use with the apparatus of FIG. 1.

FIG. 3 shows a front view of the plate 14 for use with the apparatus 1 of FIG. 1. The plate 14 may be a solid metal plate with the exception of openings 14*e*, 14*f*, 14*g*, 14*h*, 14*i*, 14*j*, 141, and slots or channels 14*k* and 14*m*. The plate 14 may have sides 14*a*, 14*b*, 14*c*, 14*d*, and 14*n*. The slot or channel 14*m* may be substantially semicircularly shaped. The slot or channel 14*m* may also be called an arcuate slot. The slot or channel 14*k* may have a left end 14*o* and a right end 14*p*. The slot or channel 14*k* may be substantially linear and may be called a substantially linear slot. The slot 14*k* may have a length and a width, wherein its length is substantially greater than its width. The plate 14 has a length and a width, wherein the length is substantially greater than the width. A dashed line L2 is shown in FIG. 3. The dashed line L2 approximately bisects the plate 14 along the length of the plate 14. The arcuate slot 14*m* may be substantially to one side of the dashed line L2. The hole 141 may be at least partially surrounded by the arcuate slot 14*m*. If the semicircle shown by arcuate slot 14*m* was made or finished into a complete circle, the hole 141 would be at the center of the complete circle. The hole 141 may be the focus or focal point of the arcuate slot 14*m*.

Figure 4:
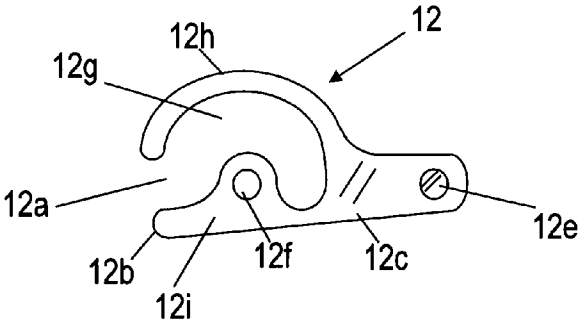
FIG. 4 shows a front view of a cam slide for use with the apparatus of FIG. 1.

FIG. 4 shows a front view of the cam slide 12 for use with the apparatus 1 of FIG. 1. The cam slide 12 includes body portion 12*c*, an extension or protrusion 12*e* shown in FIG. 1 and FIG. 4, and an extension or protrusion 12*d*, shown in FIG. 1. The cam slide 12 also includes a channel, slot, opening or notch 12*g*, having an entrance 12*a*. The body portion 12*c* includes a substantially semicircular outer portion 12*h* and a portion 12*i*. The portion 12*i* has an opening 12*f*.

Figure 5:
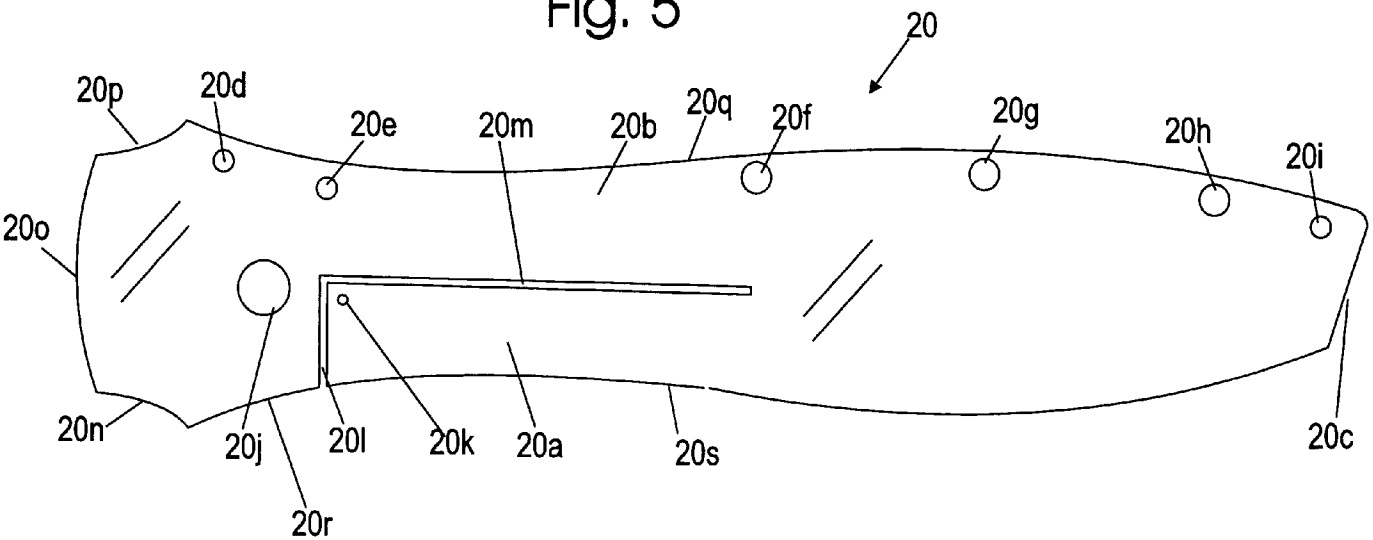
FIG. 5 shows a front view locking liner for use with the apparatus of FIG. 1.

FIG. 5 shows a front view of the locking liner 20 for use with the apparatus 1 of FIG. 1. The locking liner 20 may be a metal plate having a flexing portion or extension 20*a*, which is connected to a body portion 20*b*. The flexing portion 20*a* is separated from the body portion 20*b* by channels 201 and 20*m*. The body portion 20*b* has openings 20*d*, 20*e*, 20, 20*f*, 20*g*, 20*h*, 20*i*, and 20*j*, each of which may be circular openings. The locking liner 20 includes sides 20*c*, 20*n*, 20*o*, 20*p*, 20*q*, 20*r*, and 20*s*. The flexing portion 20*a* includes a protrusion or extension 20*k*. The flexing portion 20*a* may be used to keep or lock the knife portion 16*k* in a fully opened position shown in FIGS. 7 and 8.

FIG. 8, the back of the apparatus 1, also shows a back view of the lock side overlay 22. The lock side overlay 22 may be a metal plate. The lock side overlay 22 may include openings 22*g*, 22*h*, 22*i*, and 22*p* each of which may be circular. The lock side overlay 22 includes decorative portions 22*c*, 22*d*, and 22*e*. The lock side overlay 22 also includes decorative portions 22*k*, 221, 22*m*, 22*n*, and 22*o*. The lock side overlay 22 may also include sides 22*a*, 22*b*, and 22*f*.

The pivot pin 24 includes a body portion 24*a* which is a hollow cylinder having interior threads. The pivot pin 24 also includes screw top or cap 24*b*.

FIG. 8 also shows a back view of the pocket clip 26. The pocket clip 26 includes openings, slots or channels 26*f*, 26*g*, and 26*h*. The pocket clip 26 includes portions 26*a*, 26*b*, 26*c*, 26*d*, and 26*e*.

In operation, the apparatus 1, shown in FIG. 1, is assembled in the following manner. End 24*c* of pivot pin 24 is inserted into opening 22*p* and the rear side 22*z*, shown in FIG. 8, of the lock slide overlay 22. End 24*c* of pivot pin 24 is next inserted through the opening 20*j*, shown in FIG. 5, through the rear side (i.e. the side opposite the front side shown in FIG. 5) of locking liner 20. Ends 46*c* and 48*c* of stop pins 46 and 48 are next inserted into openings 20*d* and 20*e*, respectively, (shown in FIG. 5) of the lock liner 20. The ends 46*c* and 48*c* are connected to body portions 46*b* and 48*b*, which are constructed so that they do not fit into or through the openings 20*d* and 20*e*, respectively. In addition the spacer 18, which may be a metal plate, is placed over the front side of the locking liner 20 as shown in FIG. 1. Next, portion 44*c* of the alignment pin 44 in inserted through an opening in the spacer 18 and into the opening 20*i* of the locking liner 20. Portion 44*b* of the alignment pin 44 cannot fit into the opening 20*i*.

Next, the end 24*c* of the pivot pin 24 is inserted through the washer 42 and through the rear side of the opening 16*g* of the blade 16 opposite the front side shown in FIG. 2. The end 24*c* of the pivot pin 24 is next inserted through the washer 40. The end 24*c* is then inserted through the rear side of the opening 141 in the plate 14, which is opposite the front side shown in FIG. 3. At the same time ends 46*a* and 48*a* of the stop pins 46 and 48 are inserted into the openings 14*e* and 14*f*, respectively of the plate 14. Typically the body portions 46*b* and 48*b* cannot be inserted through the openings 14*e* and 14*f* respectively. Also at the same time, typically, portion 44*a* of the alignment pin 44 in inserted through opening 14*j* at the rear side of the plate 14. The portion 44*b* cannot fit into the opening 14*j*.

The end 24*c* of the pivot pin 24 is thereafter inserted through the slot 12*g* of the cam slide 12, which is opposite the front side shown in FIG. 4. At the same time the protrusion 12*e* of the cam slide 12 is inserted into the slot or channel 14*k* through the rear side of plate 14, on the side shown in FIG. 3. At the same time the protrusion 16*c* of the blade device 16 is inserted through the opening 12*f* through the rear side of the cam slide 12, opposite the side shown in FIG. 4.

Thereafter the end 24*c* of the pivot pin 24 is inserted into the rear side of the opening 10*j*, which is shown in FIG. 6. At the same time, the protrusion 12*d* is inserted through the slot 10*k* in the rear side of slide side overlay 10, shown in FIG. 6. The end 24*c* of the pin 24 is next inserted through an end 30*b* of the pivot collar 30. An end 28*a* of the pivot screw 28 is inserted through an end 30*a* of the pivot collar 30 and into the end 24*c* of the pivot pin 24 and screwed in until the screw 28 is connected securely within the hollow threaded body portion 24*a* of the pivot pin 24.

The extension or protrusion 12*d* of the cam slide 12 is inserted into and fixed to portion 32*b* of the slide button 32. The portion 32*b* is circular and has a diameter D1 that is slightly smaller than the width W of the slot 10*k* so that the portion 32*b* fits into and slides in the slot 10*k*. The portion 32*a* of the slide button 32 has a diameter D2, which is larger than the slot 10*k*, so that the portion 32*a* does not fit into the slot 10*k*. The extension 12*d* may be fixed to the portion 32*b* of the button 32 in any manner. For example, the extension 12*d* may have outer threads and the portion 32*b* may have inner threads into which the extension can be inserted.

Ends 34*a*, 36*a*, and 38*a*, of the frame screws 34, 36, and 38, respectively, can be inserted the through openings 100, 10*p*, and 10*q*, respectively, of the front side of the slide side overlay 10 shown in FIG. 7. The ends 34*a*, 36*a*, and 38*a* can be further inserted through the front side of openings 14*g*, 14*h*, and 14*i*(shown in FIG. 3), respectively, through the front side of openings 20*f*, 20*g*, and 20*h* (shown in FIG. 5), respectively, and through the front side of 22*i*, 22*h*, and 22*g* (opposite from side shown in FIG. 6), respectively. The screws 34, 36, and 38 can be tightened to fix the slide side overlay 10 to the lock side overlay 22 and to keep various other components of the apparatus 1 tightened together.

FIGS. 7 and 8 show the apparatus 1 in a fully opened state. The knife portion 16*k* has a length and a width, wherein the length is substantially greater than the width. The slide side overlay 10 and the lock side overlay 22 (which together may be called a housing), each have a length and a width, wherein the length is substantially greater than the width. The housing formed by both 10 and 22 also has a length and a width, wherein the length is substantially greater than the width. In the fully opened state, the length of the knife portion 16*k* is substantially parallel to the length of the housing formed by the slide side overlay 10 and the lock side overlay 22.

The clip 26 can be attached to the lock side overlay 22 by the use of screws 50 and 52 which can be inserted through openings in the clip 26 and attached to lock side overlay 22.

Note that when the apparatus 1 is fully assembled, the slot 10*k* of the slide side overlay 10 aligns with the slot 14*k* of the plate 14.

Figure 9:
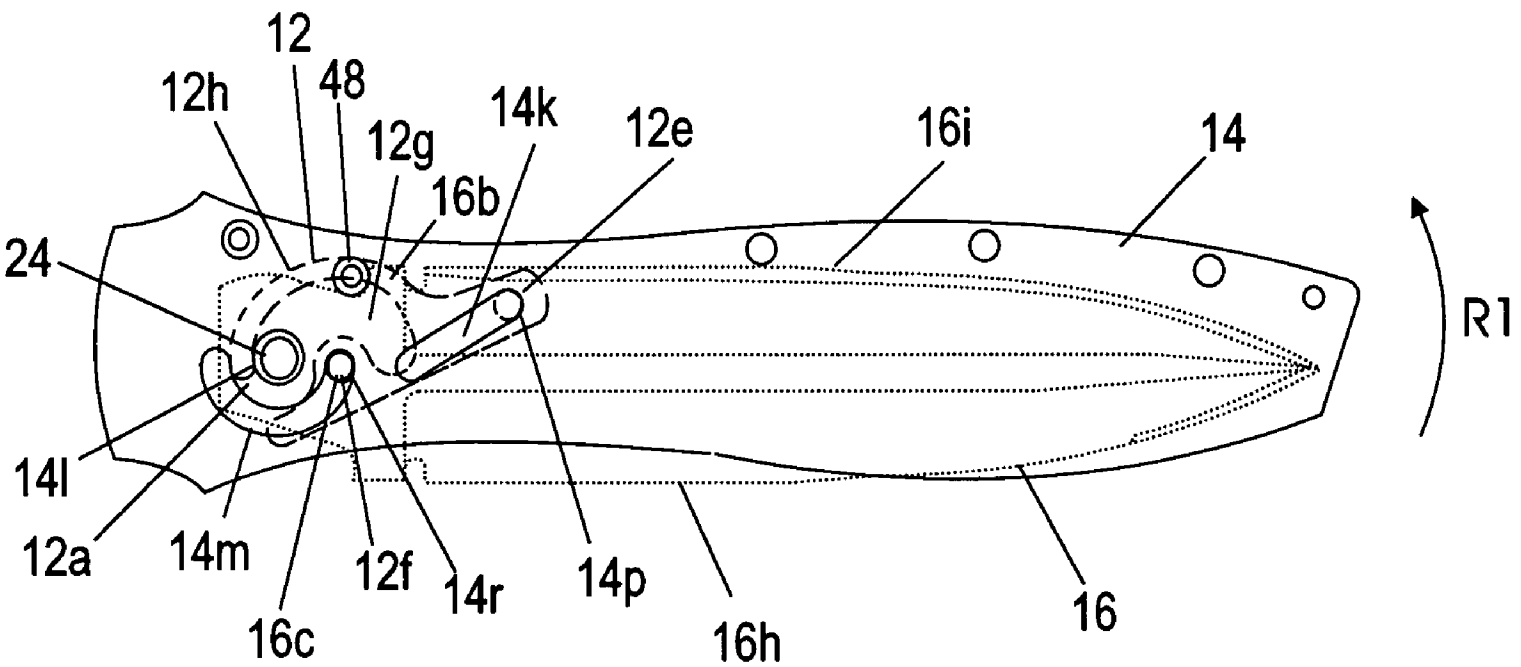
FIGS. 9–11 shows the positioning of the blade device, the plate, and the cam slide with respect to one another during a closed state, a partially open state, and a fully opened state, respectively.
Figure 10:
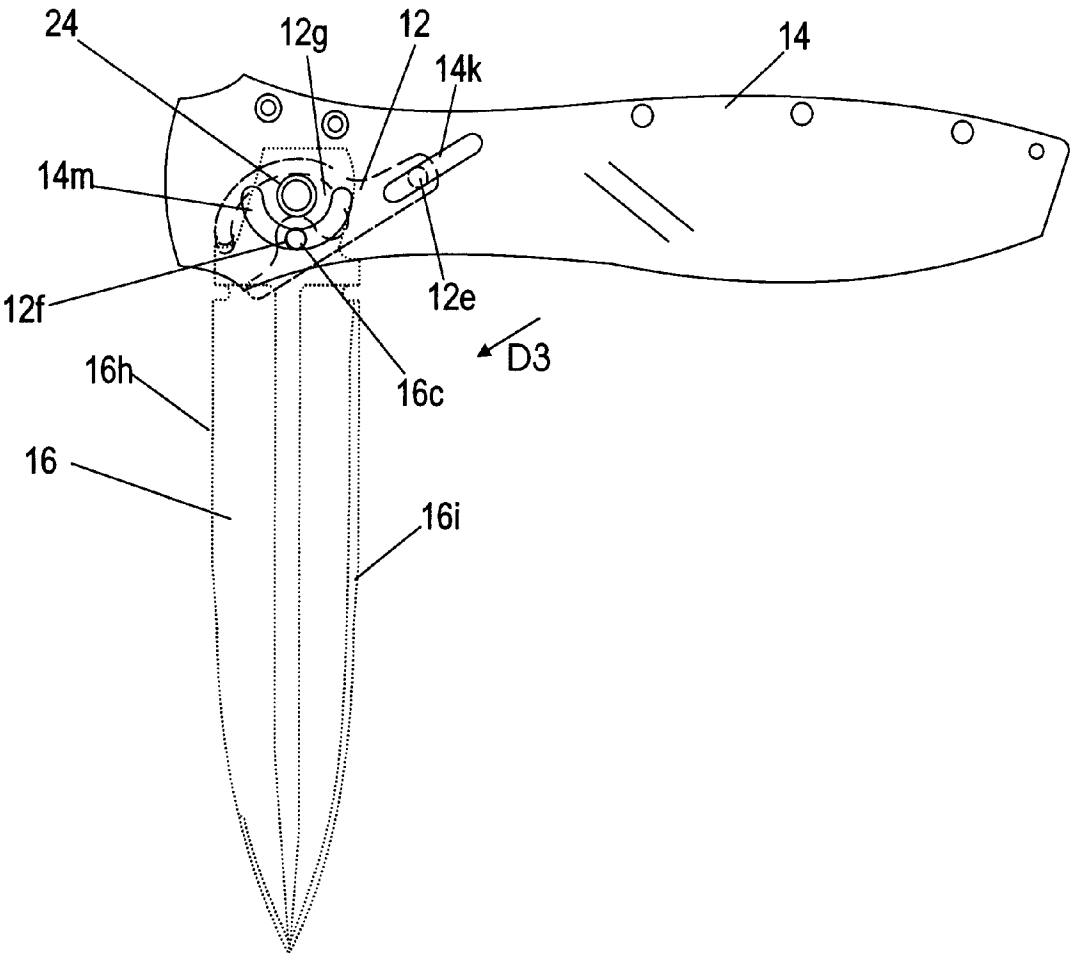
Figure 11:
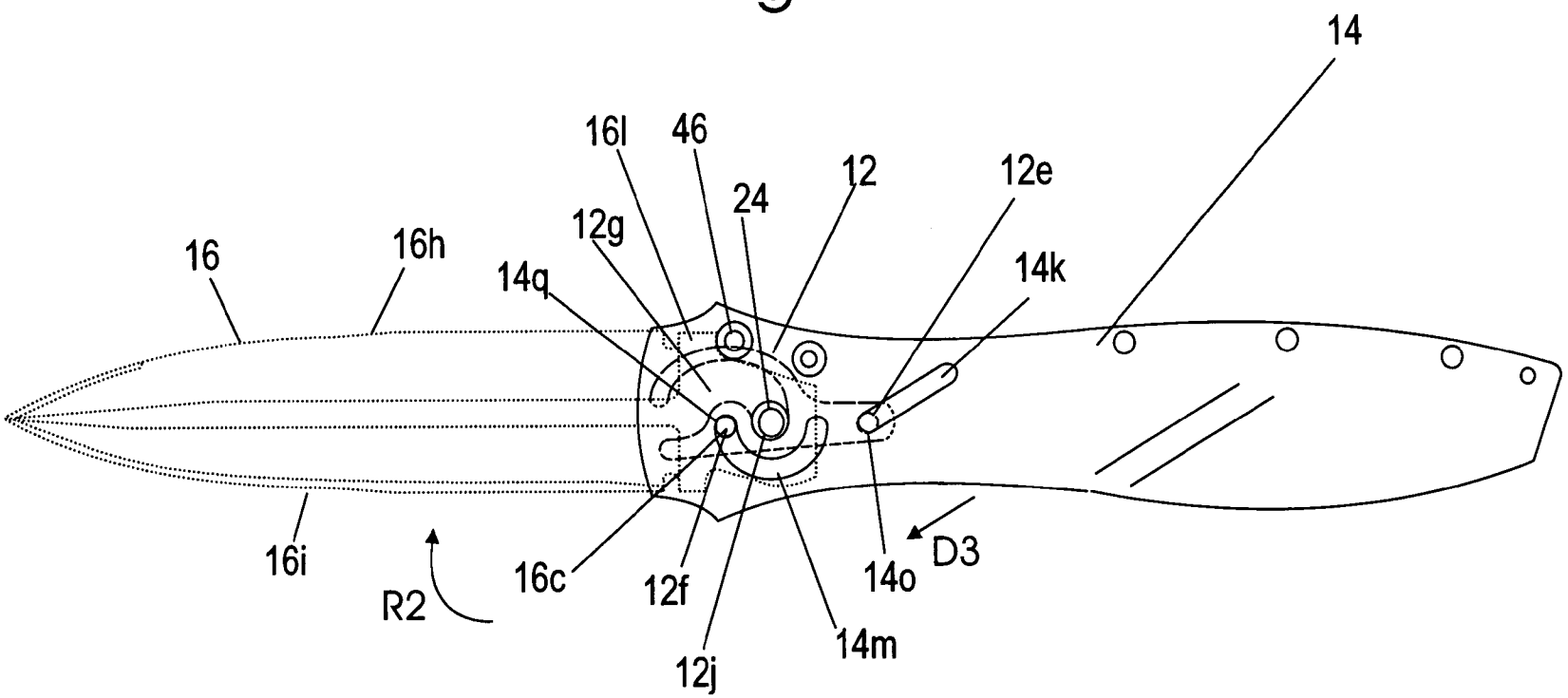

FIGS. 9–11 shows the positioning of the blade device 16, the plate 14, and the cam slide 12 with respect to one another during a closed state, a partially open state, and a fully opened state, respectively. In FIGS. 9–11 the other components of the apparatus 1 are not shown for ease of description. The plate 14 lies between the blade device 16 and the cam slide 12. In FIG. 9, the cam slide 12 would be at the top, with the plate 14 beneath the cam slide 12 and the blade device 16 beneath the plate 14.

In the closed state of FIG. 9, the extension 12*e* of the cam slide 12 lies at the back end 14*p* of the slot 14*k* of the plate 14. In addition, the pivot pin 24 lies near the opening 12*a* of the channel or slot 12*g* of the cam slide 12. The opening 12*f* of the cam slide 12 and the protrusion 16*c* of the blade device 16 lie between the pivot pin 24 and the extension 12*e* of the cam slide 12. The opening 12*f* of the cam slide 12 and the protrusion 16*c* lie at the back of the channel 14*m*, so that the cannot move any further into the channel 14*m*. In FIG. 9, the stop pin 48 stops portion 16*b* and thereby the blade device 16, from rotating any further in the rotational direction R1, which in the view of FIG. 9 is counterclockwise.

The components 12, 14, and 16, while part of an assembled apparatus 1, may be moved from a closed state as in FIG. 9 to a partially open state as in FIG. 10. In the partially open state of FIG. 10, the blade device 16 is shown substantially perpendicular to the plate 14. The plate 14 still lies between the cam slide 12 and the blade device 16. In FIG. 10, the extension 12*e* of the cam slide 12 has now moved from the back end 14*p* of the channel 14*k* in FIG. 9, to about the center of the channel 14*k*. In addition, the cam slide 12 moves so that the pivot pin 24, in FIG. 10, is now located towards the center of the channel 12*g*. Furthermore, the extension or protrusion 16*c* of the blade device 16 and the opening 12*f* of the cam slide have now moved towards the middle of the channel 14*m*.

The components 12, 14, and 16, while part of an assembled apparatus 1, may be moved from a partially open state as in FIG. 10 to a fully open state as in FIG. 11. In the fully open state of FIG. 11, the blade device 16 is shown substantially at an angle of one hundred and eighty degrees or parallel with respect to the plate 14. The plate 14 still lies between the cam slide 12 and the blade device 16. In FIG. 11, the extension 12*e* of the cam slide 12 has now moved from the center of the channel 14*k* in FIG. 10, to the front end 14*o* of the channel 14*k*, so that the extension 12*e* can no move no further in the direction D3. In addition, the cam slide 12 has now moved so that the pivot pin 24 is now located towards the back of the channel 12*g* to the extent that the end 12*j* and the cam slide 12 is prevented by the pivot pin 24 from moving any further to the left in FIG. 11. Furthermore, the extension or protrusion 16*c* of the blade device 16 and the opening 12*f* of the cam slide 12 have now moved to end 14*q* in the channel 14*m*, so that the blade device 16 cannot be rotated any further in the direction R2. The stop pin 46 stops the portion 161 and thereby the blade device 16 from rotating any further in the rotational direction R2, which when viewed as in FIG. 11, is clockwise.

In operation the portion 32*a* of the button 32, shown in FIG. 7 can be pushed to the end 10*s* of the channel 10*k*, which will place the apparatus 1 in a closed state where the components 12, 14, and 16 are positioned as shown in FIG. 9. The portion 32*a* of the button 32 can also be pushed towards end 10*t* of the channel 10*k*, which will first place the apparatus 1 in a partially open state wherein the components 12, 14, and 16 are positioned as shown in FIG. 10, and if the button 32 is pushed all the way to the end 10*t*, will place the apparatus 1 in a fully opened state, wherein the components 12, 14, and 16 are positioned as shown in FIG. 11. The apparatus 1 can thereafter be closed by moving the button 32 back to the end 10*t* of the channel 10*k*. In this manner the button 32, which is connected to extension 12*d* of the cam slide 12 can be used to open and close the blade device 16 of the apparatus 1. The end of the slot indicated as 10*s* on FIG. 7 is where the button 32 lies when the blade device 16 is closed. The end 10*t* shares approximately a same center point where the button 32 is shown in FIG. 7, which is where button "32" lies when the blade device 16 is open.

Sliding the button 32 from one end 10*t* to the other end 10*s* of the channel 10*k* shown in FIG. 7, moves the cam slide 12 and the blade device 16 from the fully opened condition shown in FIG. 11, through the partially opened position of FIG. 10, and finally to the fully closed position shown in FIG. 9. Sliding the button 32 in this manner does not affect the locking liner 20. In that sense, the locking liner 20 is independent of the button 32 and the cam slide 12. However, when the blade device 16 is in the fully opened condition as in FIG. 7, the portion or extension 20*a* of the locking liner 20 will flex outwards, as shown in FIG. 1, and thereby contact side 16*d* of the blade device 16 and prevent the blade device 16 from being moved. If the extension 20*a* is not manually pressed downwards or flexed to be even with the portion 20*b* of the locking liner 20, the button 32 and the cam slide 12 will not be able to be moved and the apparatus will be locked in the fully opened state of FIGS. 7 and 11. When portion 20*a* is flexed to be even with the portion 20*b*, then the button 32 and the cam slide 12 can be moved from the fully opened state of FIG. 11 to the partially opened state of FIG. 10. In the partially opened state of FIG. 10, the portion 20*a* will automatically be pressed or held downwards by the blade device 16, so that portion 20*a* is even or in the same plane with portion 20*b*. Thus, the button 32 and the cam slide 12 can be slid to move the blade device 16 and the cam slide 12 from the partially opened position of FIG. 10 to the fully closed position of FIG. 9.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a blade device including a knife portion having a sharp edge;

a housing, the blade device pivotally mounted to the housing by a pivot pin so that the sharp edge can be rotated in or out of the housing to place the apparatus in a closed state or an opened state, respectively;

a post attached to the blade device;

a plate having a first arcuate slot and a substantially linear slot;

a cam slide comprised of an extension which extends into the substantially linear slot, a second arcuate slot, and an opening into which the post can be inserted;

wherein the extension of the cam slide can be moved in a substantially linear manner in the substantially linear slot;

wherein the substantially linear movement of the extension in the substantially linear slot causes the sharp edge to come out of or go into the housing;

wherein the pivot pin is inserted and located at a proximal or distal end of the second arcuate slot of the cam slide;

and wherein the substantially linear movement of the extension in the substantially linear slot causes the cam slide to move and thereby causes the location of the pivot pin in the second arcuate slot to change to the other of the proximal or distal end.

2. The apparatus of claim 1 wherein the substantially linear slot has a length and a width, and wherein the length is substantially greater than the width; and wherein the extension of the cam slide is connected to a button which lies outside of the substantially linear slot, but which can be slid parallel to the direction of the length of the substantially linear slot to cause the cam slide to move and to thereby cause the sharp edge to come out of or go into the housing.

3. The apparatus of claim 1 wherein the plate has a length and a width, wherein the length of the plate is greater than the width; and wherein the first arcuate slot lies substantially to one side of a line segment running the length of the plate and bisecting the plate.

4. The apparatus of claim 3 wherein the first arcuate slot is shaped substantially in the form of a semi-circle.

5. The apparatus of claim 1 wherein the first arcuate slot is shaped substantially in the form of a semi circle.

6. The apparatus of claim 1 wherein the plate has a length and a width, wherein the length of the plate is greater than the width; and the substantially linear slot lies at an angle with respect to the length of the plate.

7. The apparatus of claim 6 wherein the first arcuate slot has a first end and a second end, wherein the first end and the second end both lie approximately along a line segment which bisects the plate along the length of the plate;

and wherein the substantially linear slot has a first end which lies approximately along the line segment.

8. The apparatus of claim 1 wherein the plate has a hole into which the pivot pin can be inserted;

and wherein the first arcuate slot at least partially surrounds the hole of the plate.

9. The apparatus of claim 1 wherein the plate has a hole into which the pivot pin can be inserted;

and wherein the first arcuate slot is substantially in the form of a semi-circle and the hole is located such that if the semi-circle were made into a complete circle, the hole would be at the center of the complete circle.

10. The apparatus of claim 1 wherein the knife portion and the housing each have a length; and further comprising a locking liner having a flexing portion which can be used keep the knife portion in an fully opened position in which the length of the knife portion is substantially parallel to the length of the housing.

11. A method comprising the steps of:

providing a blade device in an apparatus including a knife portion having a sharp edge, wherein the blade device includes a post;

pivotally mounting the blade device to a housing by a pivot pin so that the sharp edge can be rotated in or out of the housing to place the apparatus in a closed state or an opened state, respectively;

providing a plate having a first arcuate slot and a substantially linear slot;

providing a cam slide comprised of an extension which extends into the substantially linear slot, a second arcuate slot, and an opening into which the post can be inserted;

wherein the extension of the cam slide can be moved in a substantially linear manner in the substantially linear slot;

wherein the substantially linear movement of the extension in the substantially linear slot causes the sharp edge to come out of or go into the housings;

wherein the pivot pin is inserted and located at a proximal or distal end of the second arcuate slot of the cam slide; and wherein the substantially linear movement of the extension in the substantially linear slot causes the cam slide to move and thereby causes the location of the pivot pin in the second arcuate slot to change to the other of the proximal or distal end.

12. The method of claim 11 wherein the substantially linear slot has a length and a width, and wherein the length is substantially greater than the width; and further comprising connecting the extension of the cam slide to a button such that the button lies outside of the substantially linear slot, but the button can be slid parallel to the direction of the length of the substantially linear slot to cause the cam slide to move and to thereby cause the sharp edge to come out of or go into the housing.

13. The method of claim 11 wherein the plate has a length and a width, wherein the length of the plate is greater than the width; and wherein the first arcuate slot lies substantially to one side of a line segment running the length of the plate and bisecting the plate.

14. The method of claim 13 wherein the first arcuate slot is shaped substantially in the form of a semi-circle.

15. The method of claim 11 wherein the first arcuate slot is shaped substantially in the form of a semi-circle.

16. The method of claim 11 wherein the plate has a length and a width, wherein the length of the plate is greater than the width; and the substantially linear slot lies at an angle with respect to the length of the plate.

17. The method of claim 16 wherein the first arcuate slot has a first end and a second end, wherein the first end and the second end both lie approximately along a line segment which bisects the plate along the length of the plate;

and wherein the substantially linear slot has a first end which lies approximately along the line segment.

18. The method of claim 11 wherein the plate has a hole into which the pivot pin can be inserted;

and wherein the first arcuate slot at least partially surrounds the hole of the plate.

19. The method of claim 11 wherein the plate has a hole into which the pivot pin can be inserted;

and wherein the first arcuate slot is substantially in the form of a semi-circle and the hole is located such that if the semi-circle were made into a complete circle, the hole would be at the center of the complete circle.

20. The method of claim 11 wherein the knife portion and the housing each have a length; and further comprising a locking liner having a flexing portion which can be used keep the knife portion in an fully opened position in which the length of the knife portion is substantially parallel to the length of the housing.

* * * * *